US006971371B2

(12) United States Patent
Hotta et al.

(10) Patent No.: US 6,971,371 B2
(45) Date of Patent: Dec. 6, 2005

(54) AIR-FUEL MIXING AND DELIVERY APPARATUS FOR AN INTERNAL COMBUSTION ENGINE

(75) Inventors: Kazuhito Hotta, Saitama (JP); Fumie Okada, Saitama (JP); Minoru Ueda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/927,538

(22) Filed: Aug. 26, 2004

(65) Prior Publication Data

US 2005/0087175 A1 Apr. 28, 2005

(30) Foreign Application Priority Data

Sep. 30, 2003 (JP) ..... 2003-342511
Sep. 30, 2003 (JP) ..... 2003-342512

(51) Int. Cl.[7] ..... F02M 69/00; F02M 69/02; F02M 69/46

(52) U.S. Cl. ..... 123/470; 123/509; 123/337; 180/233

(58) Field of Search ..... 123/470, 506, 123/509, 472, 337, 184.21; 180/233

(56) References Cited

U.S. PATENT DOCUMENTS 4,325,341 A * 4/1982 Yamauchi et al. ..... 123/472
4,347,822 A * 9/1982 Casey ..... 123/445
4,461,263 A * 7/1984 Hasegawa ..... 123/480
6,039,029 A * 3/2000 Nagasaka et al. ..... 123/442
6,269,899 B1 * 8/2001 Izumi ..... 180/233
6,298,832 B1 * 10/2001 Yamazoe et al. ..... 123/514
6,357,413 B1 * 3/2002 Ito et al. ..... 123/197.1
6,357,424 B1 * 3/2002 Sonoda et al. ..... 123/509

FOREIGN PATENT DOCUMENTS

JP UM-A-2-127779 10/1990
JP 10-122100 A * 5/1998
JP 2003074378 A 3/2003

* cited by examiner

*Primary Examiner*—Weilun Lo
(74) *Attorney, Agent, or Firm*—Carrier, Blackman & Associates, P.C.; William D. Blackman; Joseph P. Carrier

(57) ABSTRACT

An air-fuel mixing and delivery apparatus for an internal combustion engine is situated to be shielded from exposure to water or mud during travel of a vehicle, to protect fuel system components such as a fuel injector. In the air-fuel mixing and delivery apparatus, an air-intake port, a throttle body, and an air cleaner are arranged substantially linearly and extending rearwardly above a main body of the internal combustion engine, toward the rear of the vehicle. A fuel injector is positioned on the side of the throttle body, below a seat of the vehicle. The apparatus may include a fuel pump operatively attached to the throttle body as well as a fuel injector, so that the apparatus can be compactly consolidated. Optionally, a pressure regulator may also be attached to the throttle body.

5 Claims, 9 Drawing Sheets

AIR-FUEL MIXING AND DELIVERY APPARATUS FOR AN INTERNAL COMBUSTION ENGINE

CROSS-REFERENCE TO RELATED APPLICATIONS

The present invention claims priority under 35 USC 119 based on Japanese Patent Application No. 2003-342511, filed Sep. 30, 2003, and also based on Japanese Patent Application No. 2003-342512, filed Sep. 30, 2003. The complete disclosure of each of the above-referenced Japanese applications is incorporated by reference herein.

BACKGROUND OF THE INVENTION

1. Technical Field of the Invention

The present invention relates to an air-fuel mixture delivery apparatus for an internal combustion engine usable in a saddle-type vehicle, the apparatus including a throttle body with a fuel injector attached thereto. In one exemplary embodiment, the present invention relates to an air-fuel mixture delivery apparatus with a fuel pump operatively attached to the throttle body.

2. Background Art

Many different types of internal combustion engines are widely known and commercially available on the market today. Many modern engines use fuel injection in combination with throttle bodies. An example of a known air-fuel mixing and delivery apparatus, including a throttle body with a fuel injector, a fuel pressure regulator, and a throttle position sensor all affixed thereto, is disclosed in Microfilm in Japanese Published Patent Application No. 1-36054 (JP-UM-A-2-127779).

In the above-described Patent Document, it is said that nonuniformity of the relative position due to mounting tolerance of the respective components may be reduced, and hence the number of assembly lines may be reduced to improve workability.

In the air-fuel mixture delivery apparatus disclosed in the above-described Published Patent Document, a fuel pump is provided at a separate, spaced-apart location from the fuel injector, and is connected to the injector via a feed pipe, so that high-pressure fuel is fed through the feed pipe, on its way from the fuel pump to the fuel injector.

Therefore, in this known design, since the fuel pump has to be provided separately from the fuel injector and the throttle body, a substantial length of high-pressure piping for routing fuel is required, and as a result, the fuel injection apparatus cannot be made small.

In view of such problems, a fuel injection apparatus for an internal combustion engine is needed in which a fuel pump is located close to a throttle body, and hence the fuel injection apparatus is compactly consolidated.

SUMMARY OF THE INVENTION

The present invention has been created in light of the difficulties encountered with the known air-fuel mixing and delivery apparatus. In a first embodiment of the invention, an air-fuel mixing and delivery apparatus for an internal combustion engine is provided, which can protect fuel system components such as a fuel injector or the like by blocking water and mud during travel of the vehicle.

The first embodiment of the present invention provides an air-fuel mixing and delivery apparatus for an internal combustion engine for a saddle type vehicle, in which an air-intake port, a throttle body, and an air cleaner are arranged extending substantially linearly from a main body of the aforementioned internal combustion engine toward the rear of a vehicle body. Further in the air-fuel mixing and delivery apparatus according to the first embodiment, a fuel injector is provided on the side of the aforementioned throttle body, which is located below a seat of the vehicle.

Since the air-intake port, the throttle body, and the air cleaner extend substantially linearly from the main body of the internal combustion engine toward the rear of the vehicle body, the main body of the internal combustion engine is positioned in front of the fuel injector on the side of the throttle body, and the seat is covering the same from above. As a result of this arrangement of parts, the fuel injector is substantially shielded from exposure to water or mud splashing upwardly from the front area of the vehicle during travel.

In addition, air-intake system components such as the throttle body and the air cleaner, which are disposed behind the main body of the internal combustion engine can also be substantially protected from water or mud.

In addition to the air-fuel mixing and delivery apparatus for an internal combustion engine according to the first embodiment, a second embodiment of the invention is characterized in that a fuel pump is operatively attached to the aforementioned throttle body.

Since the fuel pump is provided together with the fuel injector on the throttle body provided with the throttle plate, the length of piping for high-pressure fuel from the fuel pump can be reduced significantly, whereby the fuel injection apparatus can be compactly consolidated.

Since, in this second embodiment, the fuel pump and the fuel injector are both operatively attached to the throttle body, the fuel system components may be compactly consolidated, whereby flexibility of layout may be improved.

In addition to the air-fuel mixing and delivery apparatus for an internal combustion engine according to the first and second embodiments hereof, in a particular application thereof, the aforementioned saddle-type vehicle is a four-wheeled all-terrain vehicle.

In the internal combustion engine for the all-terrain vehicle, air-intake system components such as the throttle body and the air cleaner, which are disposed rearwardly of the main body of the internal combustion engine, are also protected from exposure to to water or mud.

In a third embodiment of the present invention, an air-fuel mixing and delivery apparatus for an internal combustion engine includes a throttle body having a throttle plate therein, and a fuel injector attached to the throttle body for controlling the amount of fuel injected into the engine, based on the rotary speed of the engine and a position of the throttle plate. The third embodiment is further characterized in that a fuel pump and a pressure regulator for adjusting fuel pressure discharged from the fuel pump are also operatively attached to the aforementioned throttle body.

Since the fuel pump and the pressure regulator are operatively attached to the throttle body in the air-fuel mixing and transfer apparatus according to the third embodiment, the length of piping for high-pressure fuel from the fuel pump can be reduced significantly, whereby the fuel injection apparatus can be compactly consolidated.

In a particular application of the third embodiment, the aforementioned fuel pump is operatively attached to the side of the aforementioned throttle body. As a result, the air-fuel mixing and transfer apparatus including the fuel pump together with the fuel injector may further be downsized.

In a particular version of an air-fuel mixing and transfer apparatus according to the third embodiment, the longitudinal axis of the aforementioned fuel pump is oriented substantially perpendicular to the longitudinal axis of the aforementioned throttle body.

Since the longitudinal axes of the fuel pump and the throttle body are oriented substantially perpendicularly to each other, the apparatus, including the throttle body operatively attached to the fuel pump, can be further downsized.

For a more complete understanding of the present invention, the reader is referred to the following detailed description section, which should be read in conjunction with the accompanying drawings. Throughout the following description and in the drawings, like numbers refer to like parts.

DETAILED DESCRIPTION

It should be understood that only structures considered necessary for clarifying the present invention are described herein. Other conventional structures, and those of ancillary and auxiliary components of the system, are assumed to be known and understood by those skilled in the art.

Figure 1:
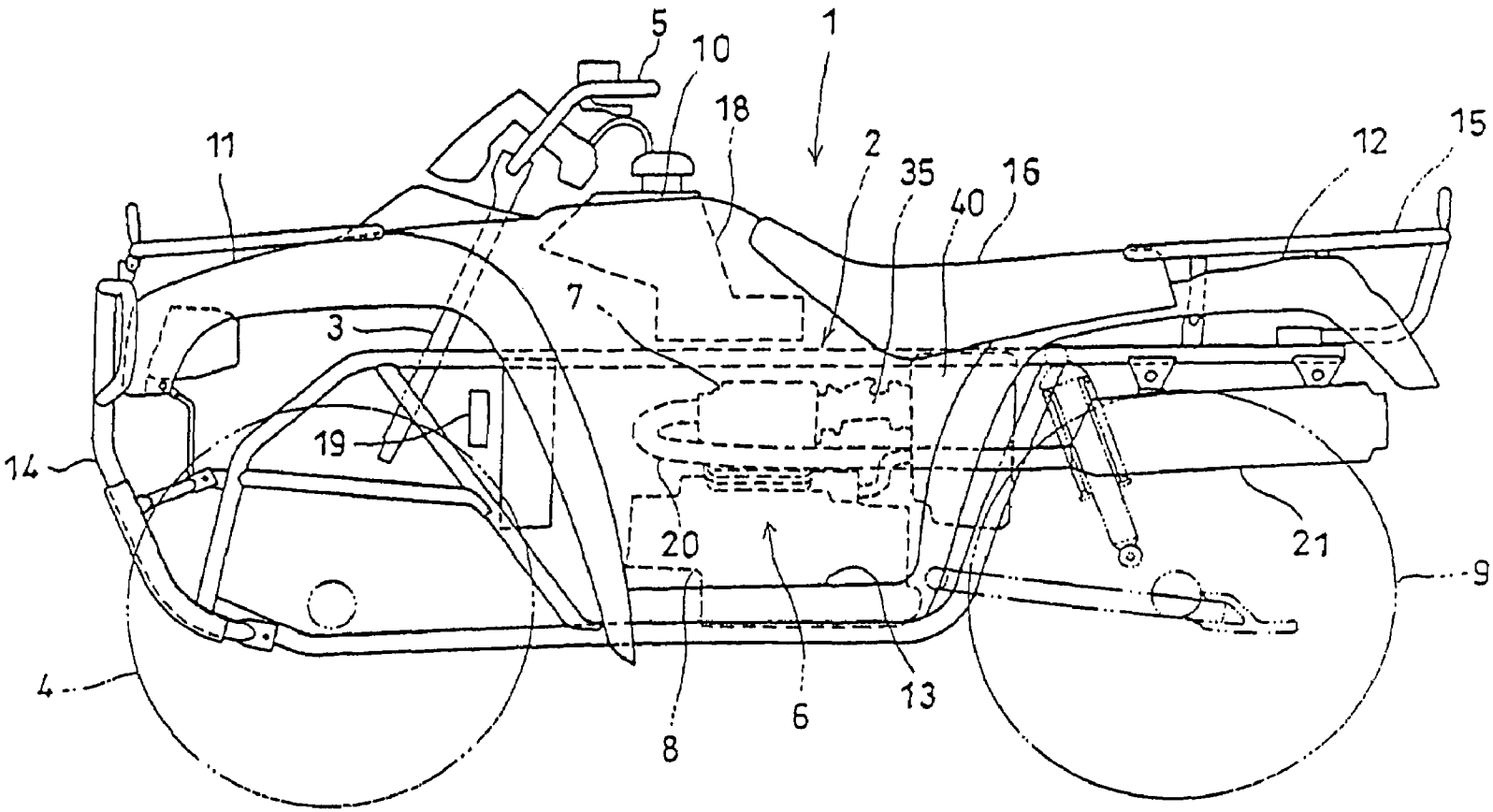
FIG. 1 is a side elevational view of an all-terrain vehicle having an air-fuel delivery apparatus mounted thereon according to a selected illustrative embodiment of the invention, in which an engine and related internal structure is shown in phantom.
Figure 2:
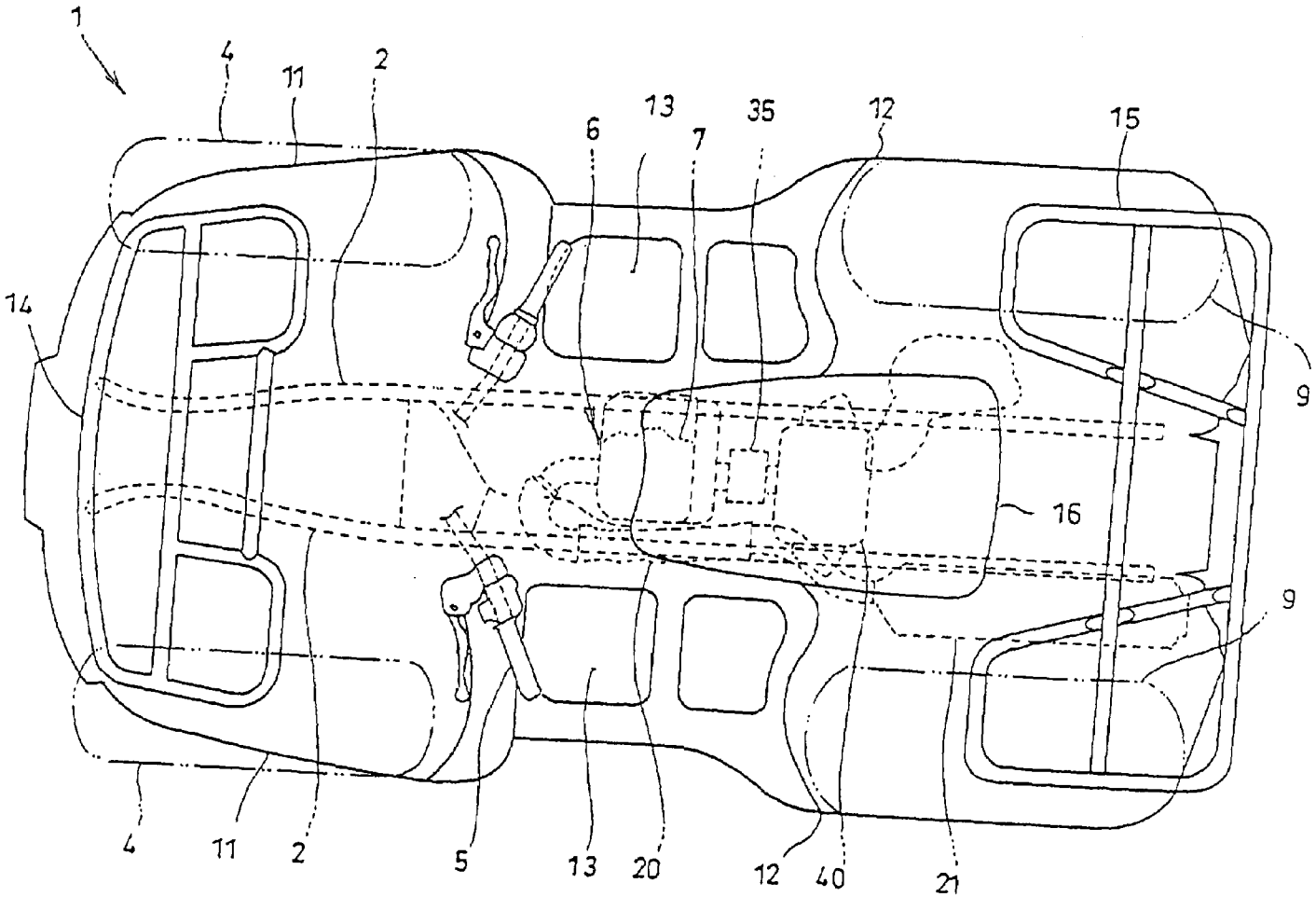
FIG. 2 is a top plan view of the vehicle of FIG. 1.
Figure 3:
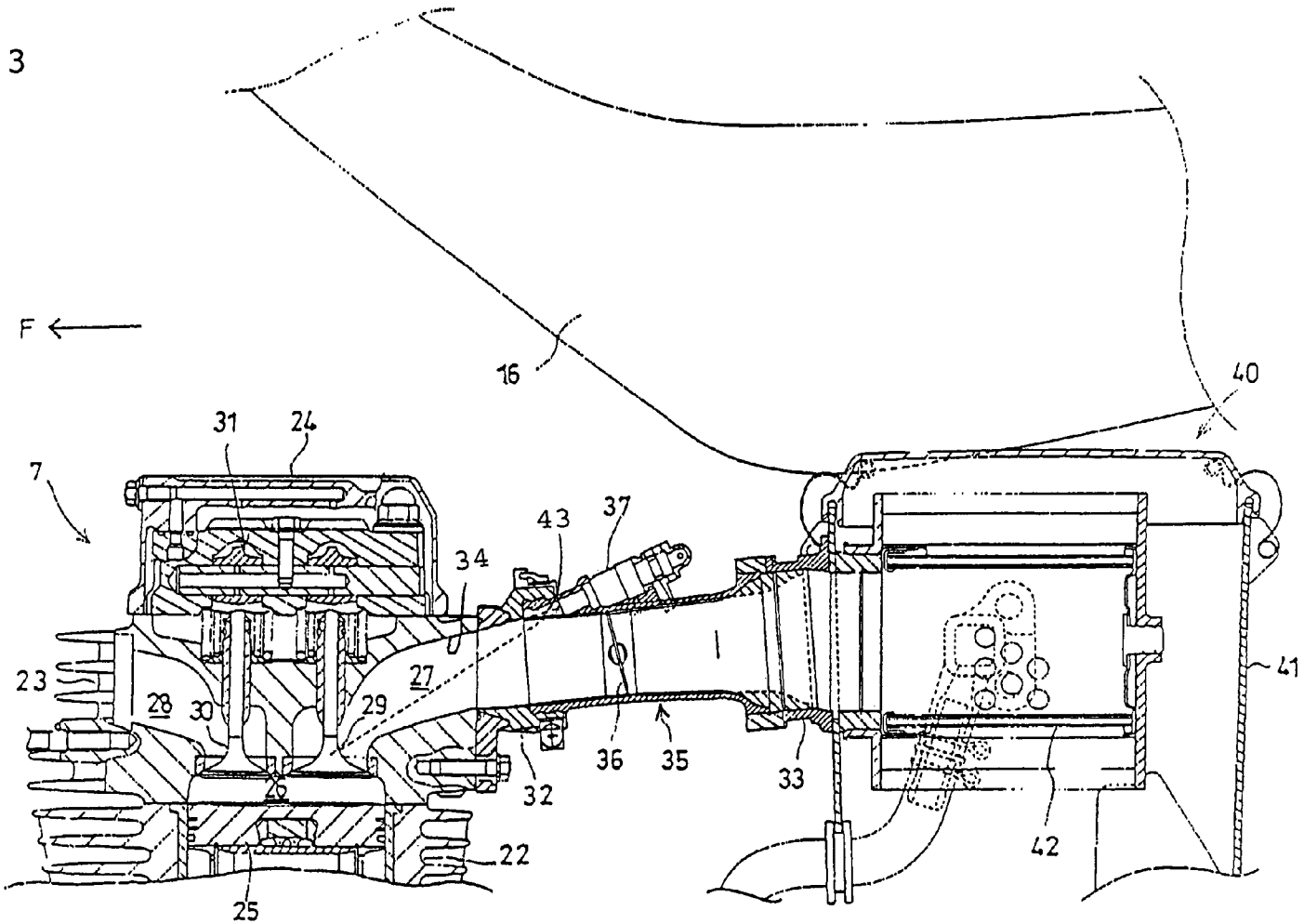
FIG. 3 is a cross-sectional view of an upper portion of an engine and air-fuel delivery apparatus according to a first embodiment hereof.

Referring to FIGS. 1–3, a first illustrative embodiment of the present invention will be described.

A vehicle 1 having an air-fuel mixing and delivery apparatus for an internal combustion engine mounted thereon, according to a first embodiment of the invention, is a four-wheeled saddle-type all-terrain vehicle, and a general side view of the vehicle 1 is shown in FIG. 1.

In the vehicle 1, the lower end of a steering shaft 3, attached to the front portion of a vehicle body frame 2, is operatively connected to left and right front wheels 4, 4. A handlebar 5 is attached to the upper end of the steering shaft 3, and a powertrain unit 6, including an internal combustion engine 7 and a transmission 8, is mounted to the center of the vehicle body frame 2. Rear wheels 9, 9 are provided at the rear portion of the vehicle body frame 2.

All four of the vehicle's wheels 4, 9 are driven by the powertrain unit 6 via a four-wheel-drive system.

A vehicle body shell 10 covers the vehicle frame 2 from above. A pair of front fenders 11, 11 cover the front wheels 4, 4 from above, and rear fenders 12, 12 cover the rear wheels 9, 9 from above, respectively. Footrests are provided by running boards 13 extending between the front and rear fenders 11, 12.

A front guard 14 is attached to the front end of the vehicle body frame 2. A rear luggage carrier 15 is attached to the rear portion thereof, and a saddle-type seat 16 is provided in front of the rear luggage carrier 15, so as to extend over an area between the powertrain unit 6 and the rear wheels 9, as shown.

A fuel tank 18 is supported by the vehicle body frame 2 between the steering shaft 3 and the seat 16, and an oil cooler 19 is disposed below the fuel tank and in front of the powertrain unit 6.

The engine 7 is a four-stroke-cycle single-cylinder internal combustion engine, and is positioned above the transmission 8 with the cylinder extending substantially upright.

An exhaust pipe 20 extending forward from a cylinder head 23 of the internal combustion engine 7 is curved left below the vehicle body and extends rearwardly, and a muffler 21 is connected to the rear end of the exhaust pipe behind the left rear wheel 9, as shown.

An air cleaner 40 is located below the seat 16, and is connected to an air inlet port 34 at the back of the cylinder head 23 via a throttle body 35, which will be described in detail referring to FIG. 3.

The internal combustion engine 7 includes a cylinder block 22 in which a piston 25 is slidably fitted, and a cylinder head 23 and a cylinder head cover 24 superimposed in sequence on the cylinder block and joined integrally thereto.

An air-intake port 27 and a discharge port 28, respectively, are formed as separate passages in the cylinder head 23, and open into a combustion chamber 26 defined by a bottom surface of the cylinder head 23. The air-intake port has an inlet opening 34 formed in a side surface of the cylinder head 23. The combustion chamber 26 faces toward the top of the piston 25.

The cylinder head 23 is provided with an air-intake valve 29 and an exhaust valve 30 so as to be capable of opening and closing the respective openings therein, and is also provided with a valve motion drive mechanism 31 for driving the air-intake valve 29 and the exhaust valve 30 on the cylinder head cover 24.

The air-intake port 27 of the cylinder head 23 is provided with an upstream inlet opening 34 facing toward the rear of the engine, as noted, and the throttle body 35 is connected to the upstream inlet opening via a first connecting pipe 32. The air cleaner 40 is connected, via a second connecting pipe 33, to the upstream opening of the throttle body 35, which extends rearwardly from the cylinder head 23.

The connecting pipe 33 interconnects the outlet opening on the filtered (downstream) side of the air cleaner 40, and the upstream opening of the throttle body 35. The air cleaner 40 is defined by an air cleaner element 42 in an air cleaner case 41.

In this manner, the inlet opening 34 for the air-intake port 27, the throttle body 35, and the air cleaner element 42 are arranged extending substantially linearly rearwardly from the cylinder head 23. The cylinder head 23 is provided extending substantially upright on the internal combustion engine 7 under the seat 16. The throttle body 35 and the air cleaner element 42 extend substantially linearly from the cylinder head 23 toward the rear of the vehicle body, above the cylinder block 22 of the internal combustion engine 7.

A fuel injector 37 is fixedly attached to the upper side of the throttle body 35 described above, and the throttle body 35 has a hollow fuel inlet passage 43 formed therein to allow fuel from the fuel injector 37 to flow into the interior of the throttle body.

The fuel injector 37 is positioned above a throttle plate 36 of the throttle body 35. The injector is attached obliquely relative to the direction of intake air flow through the throttle body 35, so as to be capable of injecting fuel toward the downstream end of the air-intake port 27.

The main body of the internal combustion engine is positioned in front of the fuel injector 37, and the seat 16 covers the same from above, as shown in FIG. 3.

Therefore, the fuel injector 37 may be substantially shielded from water or mud splashing upwardly from the front of the vehicle 1 during travel, in particular, by the cylinder head 23 and the head cover 24.

In addition, the air-intake system components such as the throttle body 35 and the air cleaner 40, which are disposed behind the main body of the internal combustion engine can also be substantially protected from water or mud during normal use.

In the practice of the present invention, the mounting position of the fuel injector 37 is not limited to the upper side of the throttle body 35, but may be the bottom, the left side or the right side, as long as it is on a side surface of the throttle body 35.

Figure 4:
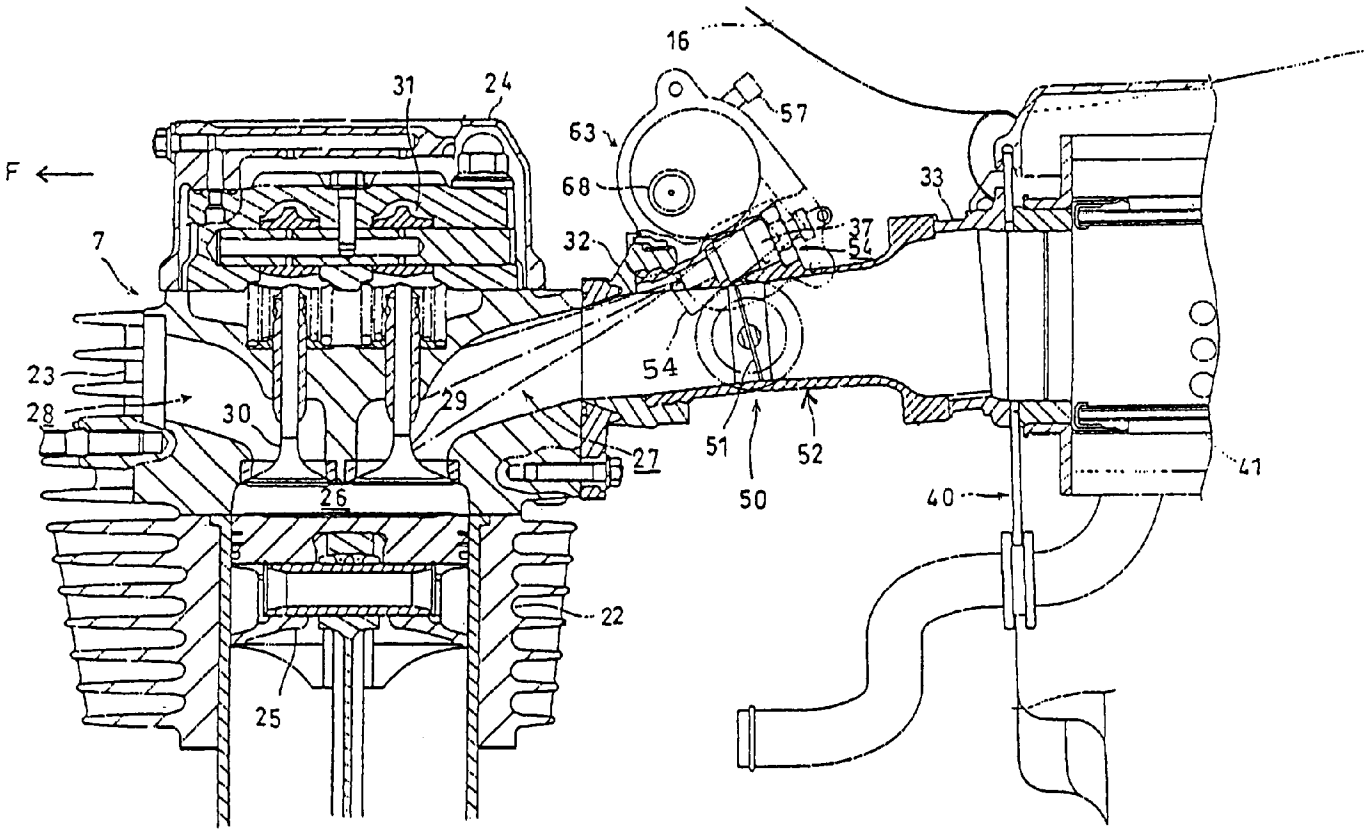
FIG. 4 is a cross-sectional view of an upper portion of an engine and air-fuel delivery apparatus according to a second embodiment hereof.

Subsequently, another embodiment, in which a fuel pump 63 and a fuel injector 37 are both operatively attached to the throttle body 52, will be described herein with reference to FIGS. 4–6.

The internal combustion engine 7, the air cleaner 40, and the fuel injector 37, other than the throttle body, are the same in the second embodiment as those as previously described in connection with the first embodiment, and hence the same components are represented by the same reference numerals.

A air-fuel mixing and delivery apparatus 50 in the second embodiment hereof has a structure including the fuel injector 37 fitted to the upper side of a throttle body 52 having a throttle plate 51, and a fuel pump 63 assembled thereon above the fuel injector 37.

Figure 5:
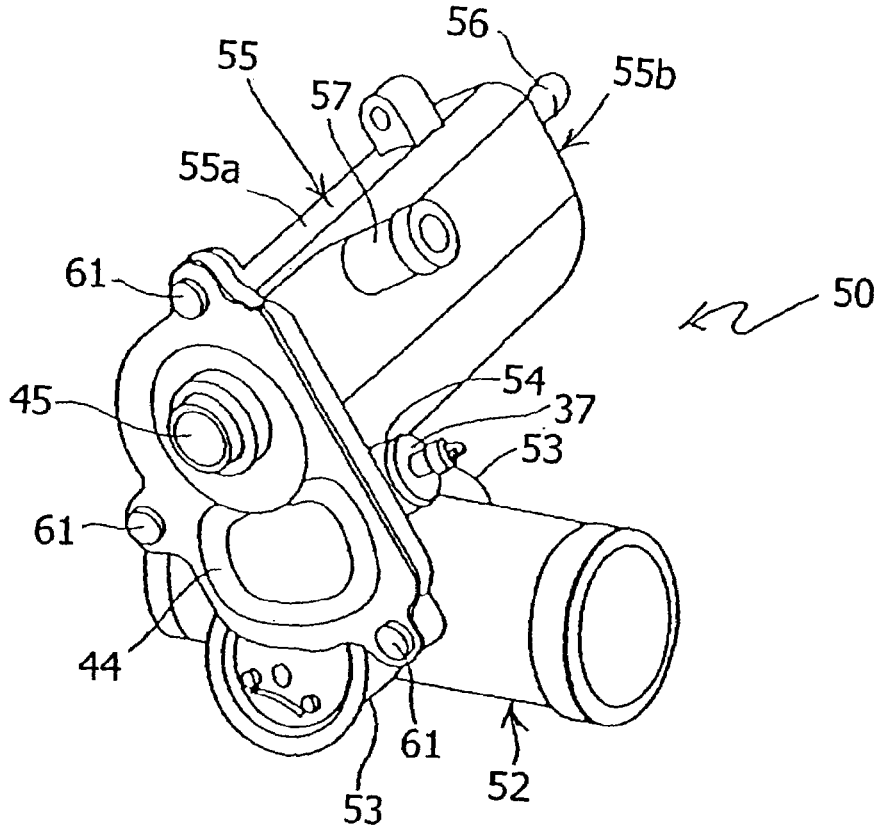
FIG. 5 is a perspective view of the air-fuel delivery apparatus of FIG. 4.
Figure 6:
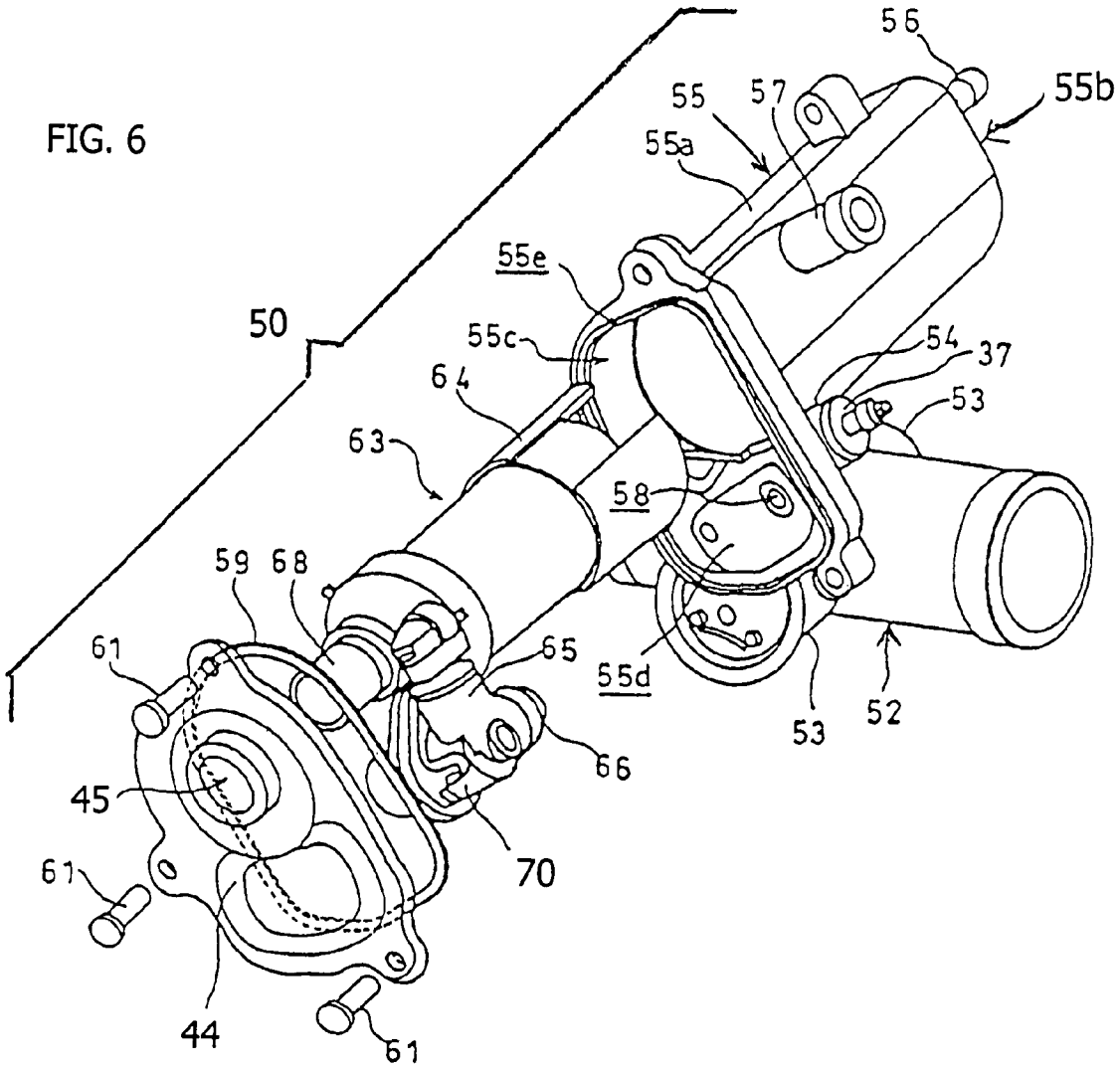
FIG. 6 is an exploded perspective view of the air-fuel delivery apparatus of FIG. 5, showing internal components thereof.

Referring now to FIGS. 5 and 6, the throttle body 52 of the air-fuel mixing and delivery apparatus 50 includes first and second valve shaft supporting cases 53, 53 extending outwardly in opposite directions thereon, for storing a valve drive mechanism and a throttle position sensor. The valve drive mechanism is provided for pivotally supporting and driving a throttle shaft, which supports the throttle plate 51 thereon.

The air-fuel mixing and delivery apparatus 50 also has an injection valve mounting hole 54 formed therein on the upper portion of the throttle body 52, for receiving the fuel injector 37.

A cylindrical pump case 55, for supporting the fuel pump 63 therein, is integrally formed with the throttle body 52 at a position above the injection valve mounting hole 54, so as to be oriented substantially perpendicular to the throttle body 52.

The center axis of the fuel injector 37 is oriented obliquely with respect to the central axis of the throttle body 52, and a nozzle portion of the injector is directed obliquely into the throttle body 52, so that the direction of injection is oriented into the air-intake port 27 at an acute angle with respect to the center axis of the throttle body 52.

Therefore, the fuel injector 37 injects a controlled amount of fuel into the throttle body for entry into the air-intake port 27 and the combustion chamber 26, based in part on the rotary speed of the engine and the throttle plate opening position.

The pump case 55 is closed at one end of a cylinder body 55*a* by an end wall 55*b*. The other end of the pump case 55 is disposed adjacent the throttle body 52, and is formed with a substantially rectangular opening 55*c* so as to protrude obliquely downwardly in a substantially rectangular shape.

The end wall 55*b* is provided with a vacuum pipe 56 projecting outwardly therefrom, and the cylinder body 55*a* is provided with a fuel return pipe 57 projecting obliquely upwardly from the side wall thereof.

The rectangular opening 55*c* is formed with a recess 55*d* therein, at a position obliquely downward of a circular hole of the cylinder body 55*a*, and a fuel feed path 58 connected to the fuel injector 37 is formed from the recess 55*d* toward the injection valve mounting hole 54.

The peripheral end surface of the opening including the recess 55*d* of the rectangular opening 55*c* is formed with a groove 55*e* extending peripherally therearound, and a sealing gasket member 59 is fitted to the groove 55*e*.

A fuel pump 63 fits inside of the cylinder body 55*a* of the pump case 55, as shown.

A fuel filter 64, formed of plastic resin, is attached to the fuel pump 63 on the front end in the direction of insertion. The fuel pump 63 is provided with a discharge pipe 66 via a check valve 65 at the rear end thereof in the direction of insertion so as to project therefrom, and a pressure regulator 70 is mounted at the midpoint of the discharge pipe 66.

When inserting the fuel pump 63 into the cylinder body 55*a* of the pump case 55, the discharge pipe 66 and the pressure regulator 70 fit into the recess 55*d* inside the rectangular opening 55*c* of the pump case 55, and the discharge pipe 66 is fitted into the fuel feed path 58 continuing to the fuel injector 37.

Then, a substantially rectangular lid member 44 is fitted on the rectangular opening 55*c* of the pump case 55, and the lid member 44 is secured to the pump case with bolts 61, as shown.

The lid member 44 is formed with an opening 45 therein, and a power distributing connector 68, projecting from the fuel pump 63, fits through this opening, and is exposed to the outside through the opening 45.

Since the fuel pump 63 and the pressure regulator 70 described above are operatively attached to the throttle body 52 to constitute the air-fuel mixing and delivery apparatus 50, the length of piping required for transferring high-pressure fuel from the fuel pump 63 to the injector 37 can be reduced significantly, thereby reducing the cost. The fuel injection apparatus can be compactly consolidated with this arrangement, and flexibility of layout of the vehicle body may be improved.

Since the fuel pump 63 is adapted to be assembled on the upper side of the air-fuel mixing and delivery apparatus 50 with the longitudinal axis thereof oriented substantially perpendicularly to the axis of the throttle body 52, the apparatus is further downsized.

Figure 7:
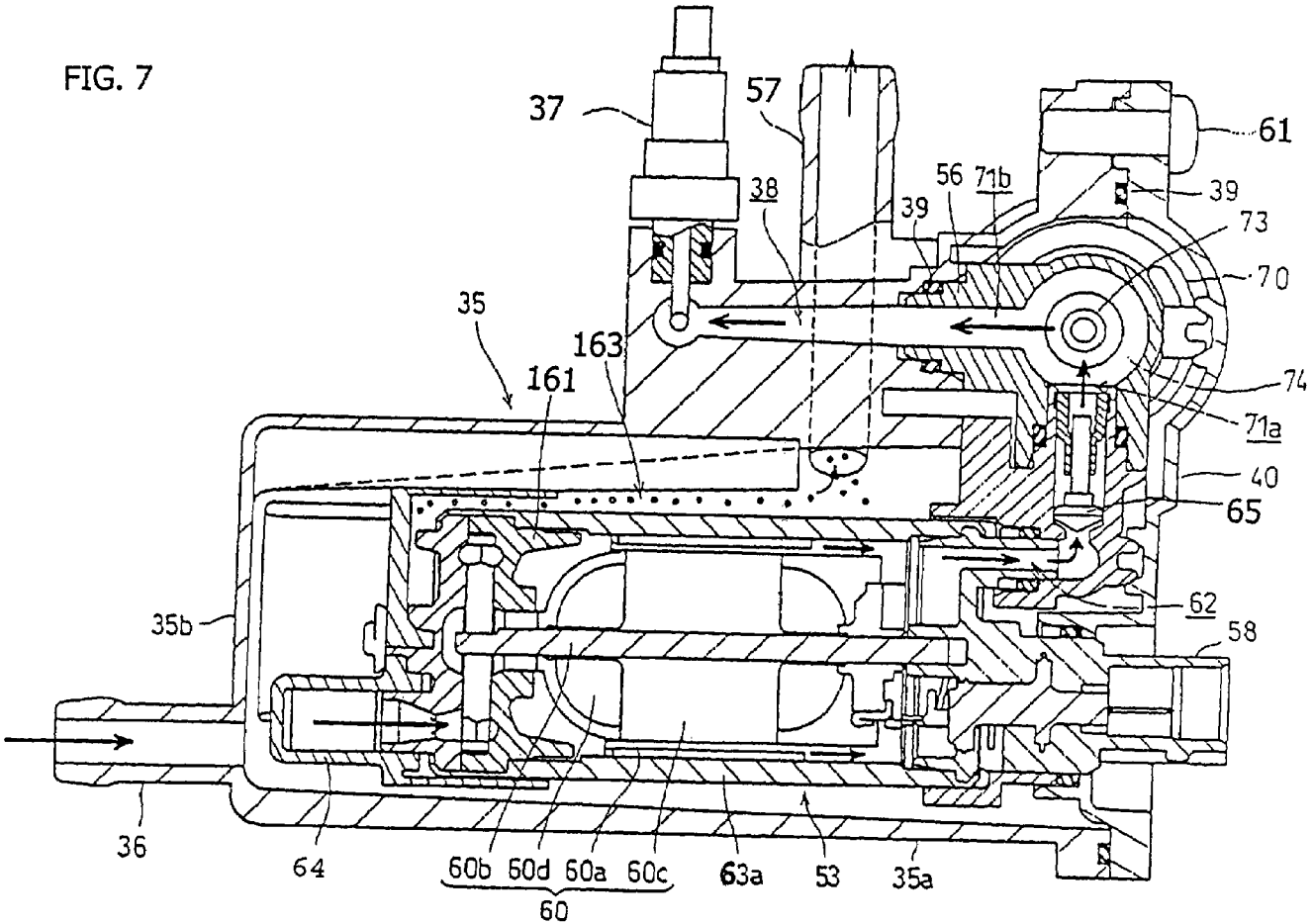
FIG. 7 is a schematic drawing, partially in cross-section, showing internal structure of the air-fuel delivery apparatus of FIGS. 4–5.

A schematic drawing of the internal structure of the fuel feed mechanism, from the fuel pump 63 to the fuel injector 37 in the apparatus 50 is shown in FIG. 7.

The fuel pump 63 is integrated in a cylindrical housing 63*a*, and a plurality of magnets 60*a* are provided along the inner peripheral surface of the cylindrical housing 63*a*. Within the cylindrical housing 63*a*, a coil 60*d* is wound around a core 60*c* formed integrally with a revolving shaft 60*b*, which is rotatably supported at both ends, so as to constitute an inner rotor.

An impeller 161 is integrally secured to one end of the revolving shaft 60*b*, and during operation of the fuel pump, a current is distributed to the coil 60*d* whereby a motor 60 is driven. When the revolving shaft 60*b* is rotated with the impeller 161, fuel is introduced from the fuel tank 18 via a fuel feed pipe (not shown), connected to the vacuum pipe 36, and then fuel which has been drawn into the cylindrical housing 63*a* via the filter 64 is discharged to a fuel channel 62 at the other end of the cylindrical housing 63*a*.

Fuel discharged into the fuel channel 62 is introduced from the fuel lead-in port 71*a* of the pressure regulator 70 via the check valve 65, is introduced from the fuel lead-out port 71*b* into the fuel feed path 38 with the pressure regulated, and is fed to the fuel injector 37 from the fuel feed path 38.

When fuel in the fuel pump 63 becomes overheated, such as during hot weather, vapor may be generated. However, fuel vapor moves upwardly in the fuel pump 63, and is returned to the fuel tank via the fuel return pipe 57, which is oriented obliquely upward from a fuel return channel 163, and a return pipe, not shown.

Figure 8:
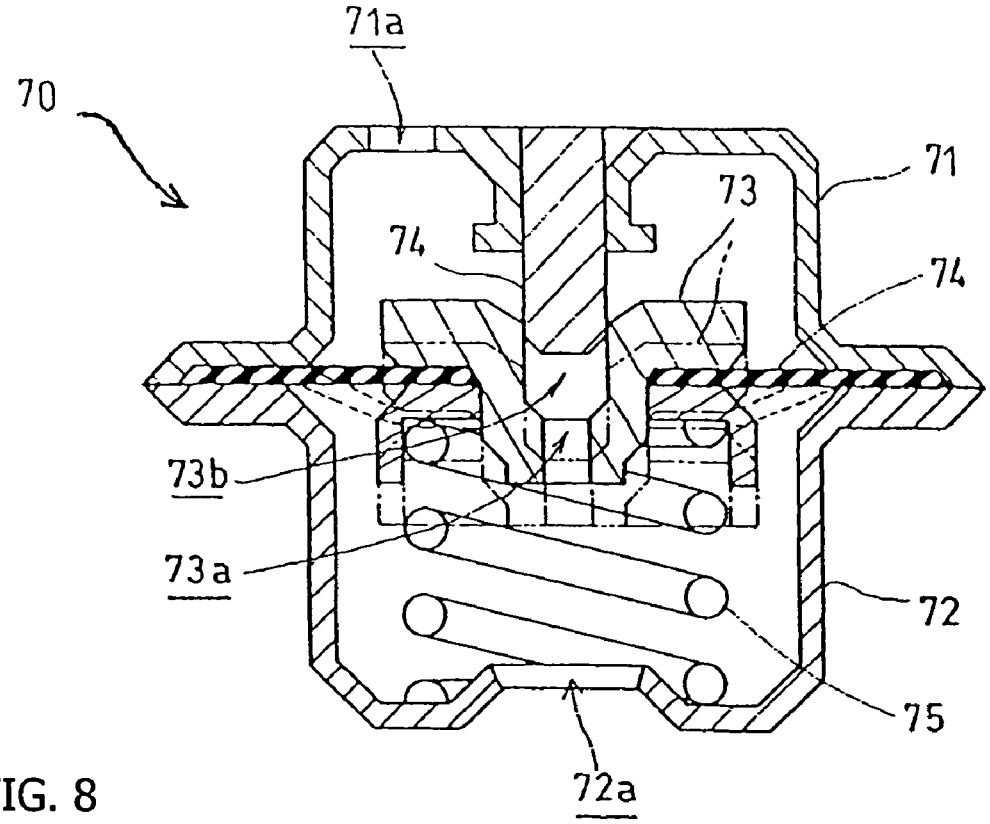
FIG. 8 is a cross-sectional view of a fuel pressure regulator, which is a component of the air-fuel delivery apparatus of FIGS. 4–5.

FIG. 8 shows a cross-sectional view of the pressure regulator 70.

An upper case section 71 and a lower case section 72 are each substantially cup-shaped, are arranged facing toward one another, and are crimpingly connected to define a space therebetween hold a diaphragm 74. The diaphragm 74 supports a valve body 73 between the upper and lower case sections 71, 72 so as to divide the internal space into upper and lower spaces.

A fuel lead-in port 71*a* and a fuel lead-out port 71*b* (See FIG. 7) are formed on the upper case section 71, and a relief port 72*a* is formed at the center of the bottom wall of the lower case 72.

The valve body 73 is formed with an opening-and-closing hole 73*a* at the center thereof, and the valve body 73 itself is urged toward the upper case 71 by a spring 75.

Above the opening-and-closing hole 73*a*, there is formed a fitting hole 73*b* having a larger diameter, and a fitting rod 74 projecting into the internal space from the upper case 71 is positioned so as to be capable of being fitted into the fitting hole 73*b*.

When the pressure of fuel introduced into the upper case 71 is a predetermined pressure or lower, the fitting rod 74 is fitted into the fitting hole 73*b* of the valve body 73, which is urged by the spring 75, to close the opening-and-closing hole 73*a*, and fuel introduced into the upper case 71 is led out from the fuel lead-out port 71*b*.

When the pressure of fuel introduced into the upper case 71 exceeds the predetermined pressure, the valve body 73 is moved toward the lower case 72 against the spring 75, and then the fitting rod 74 is pulled out from the fitting hole 73*b* of the valve body 73 to open the opening-and-closing hole 73*a*, and fuel introduced into the upper case 71 is introduced into the lower case 72, so that it can be led out from the relief port 72*a* for adjusting the pressure.

Figure 9:
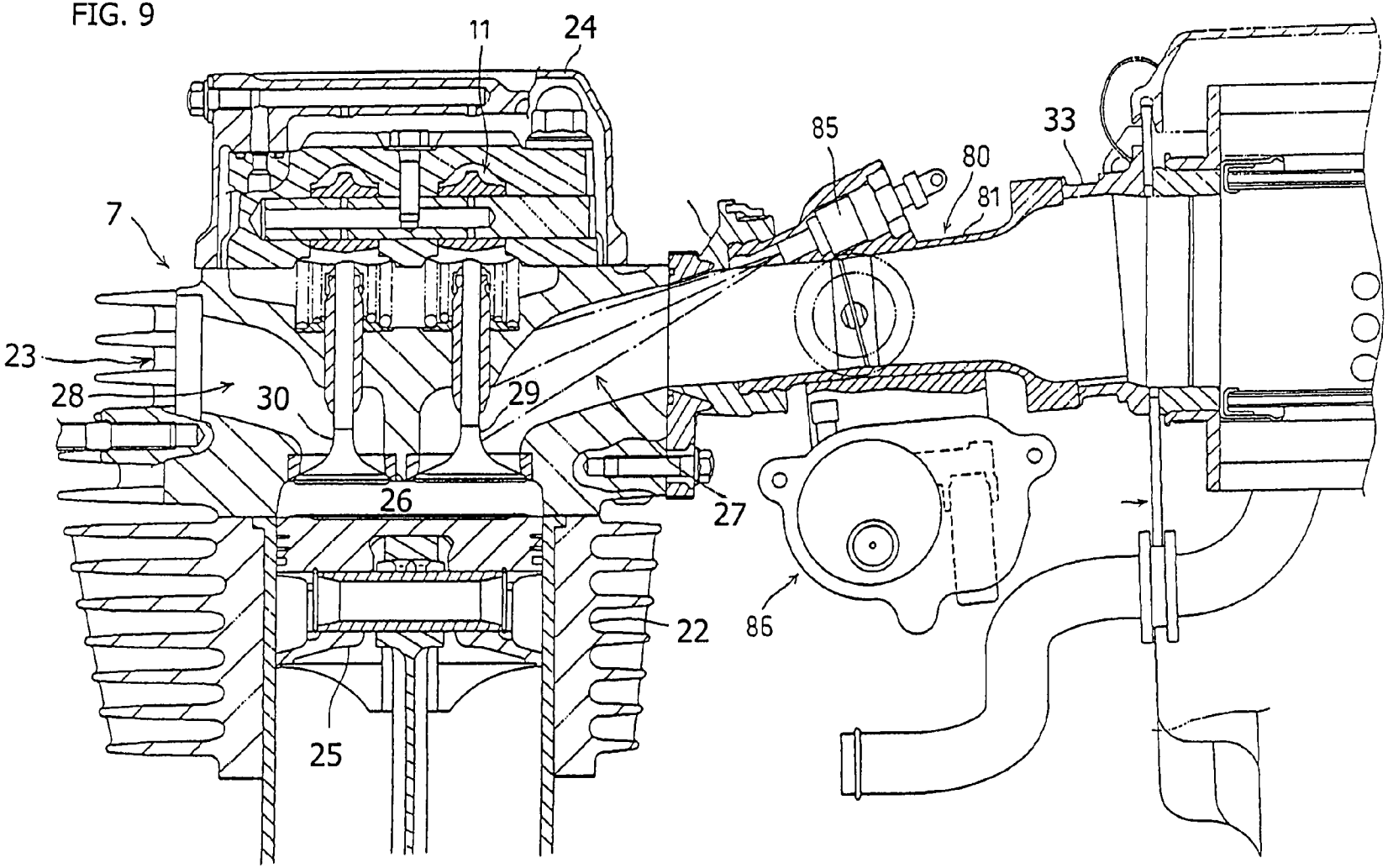
FIG. 9 is a cross-sectional view of an upper portion of an engine and air-fuel delivery apparatus according to a third embodiment hereof.

In the aforementioned embodiment, the fuel pump 63 is operatively attached to the upper side of the air-fuel mixing and delivery apparatus 50. In contrast, an example in which the fuel pump is assembled to the lower side of the throttle body will be shown in FIG. 9.

A fuel injector 85 is assembled to the upper side of a throttle body 81 of a air-fuel mixing and delivery apparatus 80, and a fuel pump 86 is assembled to the lower side of the throttle body 81.

The fuel pump 86 is formed into a cylindrical shape which is the same structure as the fuel pump 63 in the aforementioned embodiment, and is operatively attached to the throttle body 81 in the direction orthogonal thereto. The fuel pump 86 is provided with a pressure regulator together with the check valve.

In the fuel injection apparatus of the present embodiment as well, the fuel pump 86 and the pressure regulator are operatively attached to the air-fuel mixing and delivery apparatus 80, and the fuel pump 63 is assembled to the lower side of the air-fuel mixing and delivery apparatus 80. Therefore, the fuel injection apparatus can be compactly consolidated to be downsized, and hence flexibility of layout of the vehicle body may be improved.

Although the present invention has been described herein with respect to a number of specific illustrative embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

What is claimed is:

1. An air-fuel mixing and delivery apparatus for an internal combustion engine to be mounted to a saddle-type vehicle, said apparatus comprising: an air-intake port; a throttle body, and an air cleaner arranged extending substantially linearly rearwardly from said internal combustion engine toward the rear of a vehicle body; and wherein a fuel injection valve is provided on a side portion of said throttle body so that the fuel injection valve directly underlies a seat of the vehicle, and a cylinder head of the engine extends vertically upright on the engine, and the throttle body extends substantially linearly from the cylinder head toward the rear of the vehicle body, wherein said fuel injection valve is fitted to the upper side of said throttle body, and a fuel pump is mounted to said throttle body above the fuel injection valve.

2. An air-intake apparatus for an internal combustion engine according to claim 1, wherein said saddle-type vehicle is a four-wheeled all-terrain vehicle.

3. The air-fuel mixing and delivery apparatus of claim 1, wherein the fuel injection valve is oriented to expel fuel along a path which is substantially oblique to a longitudinal axis of said throttle body.

4. An air-intake apparatus for an internal combustion engine according to claim 1, wherein said fuel injection valve is fitted to the upper side of the fuel pump is oriented substantially perpendicular to the throttle body.

5. An air-fuel mixing and delivery apparatus for an internal combustion engine to be mounted to a saddle-type vehicle, said apparatus comprising:

an air-intake port extending from a rear side of the engine;

a throttle body extending horizontally rearward from said air intake port; and an air cleaner arranged extending horizontally rearwardly from said throttle body;

a fuel injection valve is provided on said throttle body, and a fuel pump housing is mounted on the throttle body, wherein the fuel injection valve is fitted to an upper side of the throttle body so as be in substantial vertical alignment with a seat of the vehicle when viewed from the side of the vehicle, and a fuel pump, a fuel pressure regulator, and a fuel filter are enclosed within the fuel pump housing, wherein the fuel pump housing resides substantially vertically above the fuel injection valve.

* * * * *